US008214071B2

(12) United States Patent
Sasaki et al.

(10) Patent No.: US 8,214,071 B2
(45) Date of Patent: Jul. 3, 2012

(54) SIMULATION METHOD, FIBER ORIENTATION CONTROL METHOD AND FIBER ORIENTATION CONTROL APPARATUS

(75) Inventors: Takashi Sasaki, Musashino (JP); Hirofumi Sano, Musashino (JP); Katsumasa Ono, Saitama (JP); Hidenobu Todoroki, Kita-ku (JP)

(73) Assignees: Yokogawa Electric Corporation, Tokyo (JP); Nippon Paper Industries Co., Ltd., Tokyo (JP)

( * ) Notice: Subject to any disclaimer, the term of this patent is extended or adjusted under 35 U.S.C. 154(b) by 260 days.

(21) Appl. No.: 12/439,944

(22) PCT Filed: Sep. 4, 2007

(86) PCT No.: PCT/JP2007/067201

§ 371 (c)(1),
(2), (4) Date: Mar. 4, 2009

(87) PCT Pub. No.: WO2008/029797

PCT Pub. Date: Mar. 13, 2008

(65) Prior Publication Data

US 2010/0276099 A1 Nov. 4, 2010

(30) Foreign Application Priority Data

Sep. 5, 2006 (JP) ..... 2006-240001

(51) Int. Cl.
*G06F 7/66* (2006.01)

(52) U.S. Cl. ..... 700/127; 162/252

(58) Field of Classification Search ..... 700/127, 700/128; 162/198, 252
See application file for complete search history.

(56) References Cited

U.S. PATENT DOCUMENTS 4,687,548 A * 8/1987 Ilmoniemi et al. ..... 162/216
4,927,347 A * 5/1990 Golata et al. ..... 425/150
5,490,905 A * 2/1996 Huovila et al. ..... 162/212

(Continued)

FOREIGN PATENT DOCUMENTS

EP 0445564 A1 9/1991

(Continued)

OTHER PUBLICATIONS

John Shakespeare, et al., An On-Line Control System for Simultaneous Optimization of Basis Weight and Orientation Angle Profiles, 1995, pp. 39-50.

(Continued)

*Primary Examiner* — Mohammad Ali
*Assistant Examiner* — Anthony Whittington
(74) *Attorney, Agent, or Firm* — Sughrue Mion, PLLC

(57) ABSTRACT

A method includes steps of: expressing changes of velocity components of a paper material at an exit of a slice lip by using a mathematical model, wherein the changes of velocity components are caused by manipulating an edge flow adjustment means (or a side bleed adjustment means) of a headbox when supplying the paper material on a wire; without changing a velocity component of a flow of the paper material in the mathematical model, setting the mathematical model based on an assumption in which a velocity component orthogonally crossing a flow direction of the paper material is proportionally changed by changes of an edge flow (or a side bleed) of a certain response width from the exit of the slice lip; and conducting a forecasting calculation of changes of a fiber orientation profile in a cross direction by using the mathematical model.

14 Claims, 9 Drawing Sheets

U.S. PATENT DOCUMENTS

| | | | | | |
|---|---|---|---|---|---|
| 5,552,021 | A | * | 9/1996 | Ilvesp aa et al. | 162/203 |
| 5,640,244 | A | * | 6/1997 | Hellstrom et al. | 356/429 |
| 5,674,363 | A | * | 10/1997 | Huovila et al. | 162/216 |
| 5,798,024 | A | * | 8/1998 | Odell et al. | 162/203 |
| 5,812,404 | A | | 9/1998 | Hamalainen et al. | |
| 5,827,399 | A | * | 10/1998 | Neittaanmaki et al. | 162/198 |
| 5,833,808 | A | * | 11/1998 | Shands et al. | 162/198 |
| 5,846,356 | A | * | 12/1998 | Vyakarnam et al. | 156/62.6 |
| 6,099,692 | A | * | 8/2000 | Weisshuhn et al. | 162/343 |
| 6,106,671 | A | * | 8/2000 | Heaven et al. | 162/198 |
| 6,200,422 | B1 | * | 3/2001 | Shakespeare et al. | 162/198 |
| 6,322,666 | B1 | * | 11/2001 | Luontama et al. | 162/198 |
| 6,402,893 | B2 | * | 6/2002 | Lumiala et al. | 162/259 |
| 6,587,652 | B2 | * | 7/2003 | Metzler | 399/45 |
| 6,799,083 | B2 | * | 9/2004 | Chen et al. | 700/128 |
| 7,164,145 | B2 | * | 1/2007 | Shakespeare | 250/559.09 |
| 7,399,380 | B2 | * | 7/2008 | Ferm et al. | 162/198 |
| 7,695,592 | B2 | * | 4/2010 | Shakespeare et al. | 162/198 |
| 2001/0027851 | A1 | * | 10/2001 | Lumiala et al. | 162/198 |
| 2002/0039495 | A1 | * | 4/2002 | Metzler | 399/45 |
| 2003/0171838 | A1 | * | 9/2003 | Chen et al. | 700/128 |
| 2006/0096727 | A1 | * | 5/2006 | Ferm et al. | 162/198 |
| 2006/0237156 | A1 | * | 10/2006 | Shakespeare et al. | 162/198 |
| 2006/0255300 | A1 | * | 11/2006 | Shakespeare | 250/559.37 |
| 2010/0276099 | A1 | * | 11/2010 | Sasaki et al. | 162/252 |

FOREIGN PATENT DOCUMENTS

| | | | |
|---|---|---|---|
| EP | 0936303 | A2 | 8/1999 |
| JP | 11-279973 | A | 10/1999 |
| JP | 2000-144597 | A | 5/2000 |
| JP | 2001-020193 | A | 1/2001 |
| JP | 2001-192992 | A | 7/2001 |
| JP | 2002-504633 | A | 2/2002 |
| JP | 2005-518484 | A | 6/2005 |
| JP | 2006-016697 | A | 1/2006 |
| WO | 9500804 | A1 | 3/1995 |
| WO | 9831873 | A1 | 7/1998 |
| WO | 0106056 | A1 | 1/2001 |
| WO | WO 3072874 | A1 * | 9/2003 |

OTHER PUBLICATIONS

Stuart Loewen, "Fiber Orientation and TSO Profiles: Headbox Design and Operation", May 24, 2005.

James Luce, "Modern Hydraulic Headboxes", May 24, 2005.

Guy A. Dumont et al., Feedback controller design for a spatially distributed system: the paper machine problem:, IEEE Transactions on Control Systems Technology, vol. 11, No. 5, Sep. 1, 2003, pp. 612-628.

Jeremy Van Antwerp et al., Fast Model Predictive Control of Sheet and Film Processes:, IEEE Transactions on Control Systems Technology, IEEE Service Center, vol. 8, No. 3, Jan. 1, 2000.

Jungiag Fan, "Model Predictive Control for Multiple Cross-Directional Processes: Analysis, Tuning and Implementation", Thesis submitted Sep. 2003, The University of British Columbia.

Cyrus Aidun, "Fiber Orientation in Headbox and Forming Jet—From Modeling to 3-D Imaging—", May 24, 2005.

Xiaosi Feng, "Numerical Model Fiber Orientation in the Converging Section of a Paper-machine Headbox using Large Eddy Simulation", Jun. 8, 2005, presented Fourth International Conference on CFD in the Oil and Gas Metallurgical & Process Industries, Trondheim, Norway.

European Search Report corresponding to European Patent Application No. 07806656.0, dated Mar. 26, 2012.

* cited by examiner

SIMULATION METHOD, FIBER ORIENTATION CONTROL METHOD AND FIBER ORIENTATION CONTROL APPARATUS

TECHNICAL FIELD

The present invention, regarding a fiber orientation angle profile of a paper machine, relates to a simulation method, a fiber orientation control method and a fiber orientation control apparatus for conducting an appropriate fiber orientation angle control.

Priority is claimed on Japanese Patent Application No. 2006-240001, filed Sep. 5, 2006, the content of which is incorporated herein by reference.

BACKGROUND ART

Even in the past, in a paper machine which produces sheets of paper from a material, i.e., pulp, it is known that a fiber orientation of the paper produced by the paper machine has influence on dimensional stability, strength and the like of the paper. Therefore, the importance of controlling the fiber orientation profile is known as well. Patent Document 1 and Non-Patent Document 1 describe paper machines which control the fiber orientation.

[Patent Document 1] Japanese Patent Application, First Publication No. 2000-144597

[Non-Patent Document 1] "An On-Line Control System for Simultaneous Optimization of Basis Weight and Orientation Angle Profiles", John Shakespeare, Juha Kniivila, Anneli Korpinen, Timo Johansson, (Proceeding of the First EcopaperTech, Finland, 1995, page 39-50)

In both Patent Document 1 and Non-Patent Document 1, there are descriptions of characteristics regarding stable changes of the fiber orientation when changing or adjusting an edge flow or a slice lip opening. However, these documents do not show a description from a quantitative view point with regard to changes or adjustments of the edge flow and/or slice lip opening. Therefore, the prior art has a problem in which it is difficult to control the fiber orientation with high accuracy.

DISCLOSURE OF INVENTION

Therefore, the present invention was conceived in order to solve the above-described problems and provides a simulation method, a fiber orientation control method, and a fiber orientation control apparatus that can control the fiber orientation with high accuracy.

In order to solve the above-described problems, the present invention has, for example, the following aspects.

A first aspect is a simulation method including the steps of: expressing changes of velocity components of a paper material at an exit of a slice lip by using a mathematical model, wherein the changes of velocity components are caused by manipulating at least one of an edge flow adjustment means and a side bleed adjustment means of a headbox when supplying the paper material on a wire; setting the mathematical model based on an assumption in which a velocity component orthogonally crossing a flow direction of the paper material is proportionally changed by at least one of changes of an edge flow and a side bleed of a certain response width from the exit of the slice lip; and conducting a forecasting calculation of changes of a fiber orientation profile in a cross direction by using the mathematical model.

A second aspect is a simulation method including the steps of: expressing changes of velocity components of a paper material at an exit of a slice lip by using a mathematical model, wherein the changes of velocity components are caused by manipulating a slice-lip-opening-adjusting means of a headbox when supplying the paper material on a wire; setting the mathematical model based on an assumption in which a velocity component in a flow direction of the paper material is proportionally changed in accordance with changes in size of the open of the slice lip and in which a velocity component orthogonally crossing the flow direction of the paper material is proportionally changed in accordance with an average value of differences of changes in size of the open in a cross direction of the slice lip; and conducting a forecasting calculation of changes of a fiber orientation profile in a cross direction by using the mathematical model.

A third aspect is a simulation method including the steps of: expressing changes of velocity components of a paper material at an exit of a slice lip by using a mathematical model, wherein the changes of velocity components are caused by manipulating a slice-lip-opening-adjusting means and at least one of an edge flow adjustment means and a side bleed adjustment means of a headbox when supplying the paper material on a wire; setting the mathematical model based on an assumption in which a velocity component in a flow direction of the paper material is proportionally changed in accordance with changes in size of the open of the slice lip and in which a velocity component orthogonally crossing the flow direction of the paper material is a sum of both changes proportional to an average value of differences of changes in size of the open in a cross direction of the slice lip and changes proportional to changes of at least one of an edge flow and a side bleed of a certain response width from the exit of the slice lip; and conducting a forecasting calculation of the changes of a fiber orientation profile in a cross direction by using the mathematical model.

A fourth aspect is a simulation method including the steps of expressing changes of velocity components of a paper material at an exit of a slice lip by using a mathematical model, wherein the changes of velocity components are caused by manipulating at least one of an edge flow adjustment means and a side bleed adjustment means of a headbox when supplying the paper material on a wire; setting the mathematical model based on an assumption in which a velocity component orthogonally crossing a flow direction of the paper material is proportionally changed by at least one of the changes of an edge flow and a side bleed of a certain response width from the exit of the slice lip; and based on an evaluation function calculated by using a forecasting calculation means which calculates changes of a fiber orientation profile in a cross direction in accordance with the mathematical model, calculating at least one of an operation amount of an edge flow and an optimized operation amount of a side bleed.

A fifth aspect is a simulation method characterized by including the steps of: expressing changes of velocity components of a paper material at an exit of a slice lip by using a mathematical model, wherein the changes of velocity components are caused by manipulating a slice-lip-opening-adjusting means of a headbox when supplying the paper material on a wire; setting the mathematical model based on an assumption in which a velocity component in a flow direction of the paper material is proportionally changed in accordance with changes in size of the open of the slice lip and in which a velocity component orthogonally crossing the flow direction of the paper material is proportionally changed in accordance with an average value of differences of changes in size of the open in a cross direction of the slice lip; and based on an evaluation function calculated by using a forecasting calculation means which calculates changes of a fiber orientation profile in a cross direction in accordance with the mathematical model, calculating an operation amount of opening/closing the slice lip.

A sixth aspect is a simulation method including the steps of: expressing changes of velocity components of a paper material at an exit of a slice lip by using a mathematical model, wherein the changes of velocity components are caused by manipulating a slice-lip-opening-adjusting means and at least one of an edge flow adjustment means and a side bleed adjustment means of a headbox when supplying the paper material on a wire; setting the mathematical model based on an assumption in which a velocity component in a flow direction of the paper material is proportionally changed in accordance with the changes in size of the open of the slice lip and in which a velocity component orthogonally crossing the flow direction of the paper material is a sum of both changes proportional to an average value of differences of changes in size of the open in a cross direction of the slice lip and changes proportional to changes of at least one of an edge flow and a side bleed of a certain response width from the exit of the slice lip; and based on an evaluation function calculated by using a forecasting calculation means which calculates changes of a fiber orientation profile in a cross direction in accordance with the mathematical model, calculating an operation amount of opening/closing the slice lip and at least one of an operation amount of an edge flow and an optimized operation amount of a side bleed.

A seventh aspect is a simulation method according to one of the fourth to fifth aspects, wherein a sum of squares of control deviation is applied to the evaluation function for calculating the optimized operation amount of opening/closing the slice lip and at least one of the optimized operation amount of the edge flow and the optimized operation amount of the side bleed.

An eighth aspect is a simulation method according to the seventh aspect, wherein a method of steepest descent is applied with regard to the evaluation function for calculating the optimized operation amount of opening/closing the slice lip and at least one of the optimized operation amount of the edge flow and the optimized operation amount of the side bleed.

A ninth aspect is a simulation method characterized by including the steps of: expressing changes of velocity components of a paper material at an exit of a slice lip by using a mathematical model, wherein the changes of velocity components are caused by manipulating at least one of an edge flow adjustment means and a side bleed adjustment means of a headbox when supplying the paper material on a wire; setting the mathematical model based on an assumption in which a velocity component orthogonally crossing a flow direction of the paper material is proportionally changed by at least one of changes of an edge flow and a side bleed of a certain response width from the exit of the slice lip; and based on an evaluation function calculated by using a forecasting calculation means which calculates changes of a fiber orientation profile in a cross direction in accordance with the mathematical model, calculating at least one of an operation amount of an edge flow and an optimized operation amount of a side bleed; based on at least one of the optimized operation amount of the edge flow and the optimized operation amount of the side bleed, adjusting at least one of the edge flow adjustment means and the side bleed adjustment means.

A tenth aspect is a simulation method characterized by including the steps of expressing changes of velocity components of a paper material at an exit of a slice lip by using a mathematical model, wherein the changes of velocity components are caused by manipulating a slice-lip-opening-adjusting means of a headbox when supplying the paper material on a wire; setting the mathematical model based on an assumption in which a velocity component in a flow direction of the paper material is proportionally changed in accordance with changes in size of the open of the slice lip and in which a velocity component orthogonally crossing the flow direction of the paper material is proportionally changed in accordance with an average value of differences of changes in size of the open in a cross direction of the slice lip; based on an evaluation function calculated by using a forecasting calculation means which calculates changes of a fiber orientation profile in a cross direction in accordance with the mathematical model, calculating an operation amount of opening/closing the slice lip; and based on the optimized operation amount of opening/closing the slice lip, adjusting the slice-lip-opening-adjustment means and the side bleed adjustment means.

An eleventh aspect is a simulation method including the steps of: expressing changes of velocity components of a paper material at an exit of a slice lip by using a mathematical model, wherein the changes of velocity components are caused by manipulating a slice-lip-opening-adjusting means and at least one of an edge flow adjustment means and a side bleed adjustment means of a headbox when supplying the paper material on a wire; setting the mathematical model based on an assumption in which a velocity component in a flow direction of the paper material is proportionally changed in accordance with changes in size of the open of the slice lip and in which a velocity component orthogonally crossing the flow direction of the paper material is a sum of both changes proportional to an average value of differences of changes in size of the open in a cross direction of the slice lip and changes proportional to changes of at least one of an edge flow and a side bleed of a certain response width from the exit of the slice lip; based on an evaluation function calculated by using a forecasting calculation means which calculates changes of a fiber orientation profile in a cross direction in accordance with the mathematical model, calculating an operation amount of opening/closing the slice lip and an operation amount of at least one of an edge flow and a side bleed; and based on the operation amount of opening/closing the slice lip and at least one of the operation amount of the edge flow and the operation amount of the side bleed, adjusting the slice-lip-opening-adjustment means and at least one of the edge flow adjustment means and the side bleed adjustment means.

A twelfth aspect is a simulation method according to one of $9^{th}$-$11^{th}$ aspects, wherein a sum of squares of control deviation is applied to the evaluation function for calculating the operation amount of opening/closing the slice lip and the operation amount of at least one of the edge flow and the side bleed.

A thirteenth aspect is a simulation method according to the twelfth aspect, wherein a method of steepest descent is applied with regard to the evaluation function for calculating the operation amount of opening/closing the slice lip and at least one of the operation amount of the edge flow and the operation amount of the side bleed.

The present invention has the above-described aspects, and it is possible to provide, for example, following advantages.

In accordance with the above-described first aspect, it is possible to calculate changes of the fiber orientation profile when adjusting at least one of the edge flow and the side bleed. Therefore, there is an advantage in which it is possible to calculate or observe the changes of the fiber orientation profile in a width direction from a quantitative view point.

In accordance with the above-described second aspect, it is possible to calculate changes of the fiber orientation profile when changing or adjusting a slice lip opening. Therefore, there is an advantage in which it is possible to calculate or observe the changes of the fiber orientation profile in a width direction from a quantitative view point.

In accordance with the above-described third aspect, it is possible to calculate changes of the fiber orientation profile when adjusting or changing at least one of the slice lip opening, the edge flow and the side bleed. Therefore, there is an advantage in which it is possible to calculate or observe the changes of the fiber orientation profile in a width direction from a quantitative view point.

In accordance with the above-described fourth aspect, it is possible to calculate at least one of the optimized manipulated variable of the edge flow and the optimized manipulated variable of the side bleed. Therefore, there is an advantage in which it is possible to control the fiber orientation with high accuracy.

In accordance with the above-described fifth aspect, it is possible to calculate the optimized manipulated variable of the slice lip opening. Therefore, there is an advantage in which it is possible to control the fiber orientation with high accuracy.

In accordance with the above-described sixth aspect, it is possible to calculate at least one of the optimized manipulated variable of the slice lip opening, the optimized manipulated variable of the edge flow and the optimized manipulated variable of the side bleed. Therefore, there is an advantage in which it is possible to control the fiber orientation with further high accuracy.

In accordance with the above-described seventh aspect, it is possible to calculate the optimized manipulated variable. Therefore, there is an advantage in which it is possible to control the fiber orientation with high accuracy from a quantitative view point.

In accordance with the above-described eighth aspect, it is possible to calculate an optimized manipulated variable for obtaining the most steeply dropping result of an evaluation function. Therefore, there is an advantage in which it is possible to calculate the optimized manipulated variable.

In accordance with the above-described ninth aspect, it is possible to conduct an adjustment operation based on at least one of the optimized edge flow and the optimized side bleed.

Therefore, there is an advantage in which it is possible to provide the products with uniform fiber orientation.

In accordance with the above-described ninth aspect, it is possible to adjust the slice lip so as to have an optimized opening.

Therefore, there is an advantage in which it is possible to provide the products with uniform fiber orientation. In addition, in accordance with the above-described ninth aspect, it is possible to locally or partially adjust the slice lip opening. Therefore, there is an advantage in which it is possible to control or adjust the local or partial fiber orientation.

In accordance with the above-described eleventh aspect, it is possible to conduct an adjustment operation based on at least one of the optimized slice lip opening, the optimized edge flow and the optimized side bleed.

Therefore, there is an advantage in which it is possible to provide the products with further uniform fiber orientation. This is because, by controlling the opening of the slice lip, it is possible to control or adjust the local or partial fiber orientation. In addition, by controlling at least one of the edge flow and side bleed, it is possible to control or adjust the overall fiber orientation. Hence, by combining the edge flow and the side bleed, it is possible to control the fiber orientation with further high accuracy.

In accordance with the above-described twelfth aspect, it is possible to calculate the optimized manipulated variable. Hence, there is an advantage in which it is possible to control the fiber orientation with high accuracy from a quantitative view point.

In accordance with the above-described thirteenth aspect, it is possible to calculate an optimized manipulated variable for obtaining the most steeply dropping result of an evaluation function. Therefore, there is an advantage in which it is possible to calculate the optimized manipulated variable.

DESCRIPTION OF THE REFERENCE SYMBOLS

Figure 1:
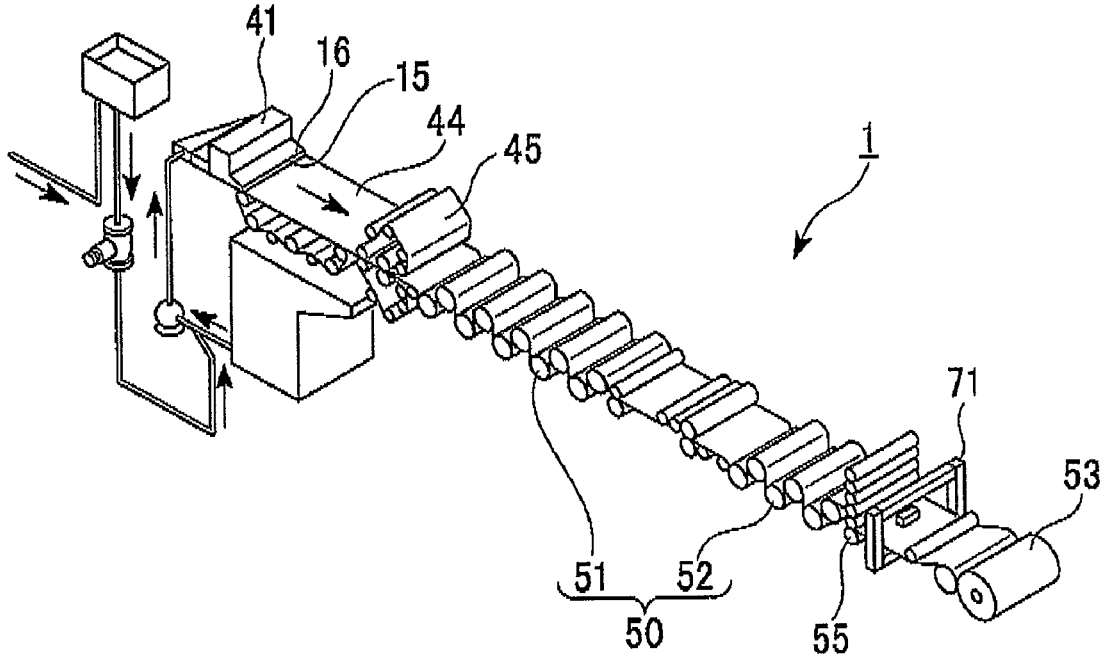
FIG. 1 is an outline of a perspective view of a paper machine of one embodiment.

1 . . . paper machine
15 . . . slice lip
16 . . . slice bolt (slice-lip-opening adjusting unit)
22, 24 . . . edge flow valve (edge flow adjusting unit)

32, 34 . . . side bleed valve (side bleed adjusting unit)
41 . . . headbox
44 . . . wire part (wire)
71 . . . fiber orientation measuring device
72 . . . control portion
81 . . . slice bolt manipulation portion
82 . . . edge flow valve manipulating portion
83 . . . side bleed valve manipulating portion
91 . . . actual fiber orientation profile generation portion
92 . . . actual fiber orientation profile comparing portion
93 . . . calculation-for-controlling portion

BEST MODE FOR CARRYING OUT THE INVENTION

Hereinafter, in reference to the drawings, preferable embodiments of the present invention are explained. It should be noted that each of embodiments below is not a limitation on the present invention, and for example, it is possible to combine constitutional elements of these embodiments if necessary.

As shown in FIG. 1, a paper machine 1 has a headbox 41 which supplies the material of the paper. In a downstream direction of a flow of the paper material from the headbox 41, a wire part 44 is constituted for dehydrating the paper material after being supplied on a surface of a wire. A surface of the paper which touches the wire when the jet (paper material) lands on the wire for the first time is called a wire surface, and the opposite side of the paper is called a felt surface. In a downstream direction from the wire part 44, a press part 45 is provided. The press part 45 presses the paper material together with a felt by using a press roll in order to squeeze water from the paper material. In addition, in a downstream direction from the press part 45, a dry part 50 is provided for drying the produced paper. The dry part 50 is constituted from both, a pre-dryer 51 which applies preheat and an after-dryer 52 which improves a drying operation continuously after the pre-dryer 51. In addition, in a downstream direction from the dry part 50, a calender part 55 is provided for strongly pressing the paper which is made from the paper material after being dried by the dry part 50. In a downstream direction from the calender part 55, a reel part 53 is provided for reeling the paper.

FIG. 1 shows an example of Fourdrinier paper machine. However, the present invention can be applied to various types of paper machines (gap former, on-top former, and the like).

In this embodiment, a fiber orientation measuring device 71 is provided as a fiber orientation measuring unit just before the reel part 53. In a case in which a fiber orientation of each of the wire surface and the felt surface is measured, the fiber orientation measuring devices 71 are provided so as to face each of the wire surface and the felt surface. On the other hand, in a case in which a fiber orientation of one of the wire surface and the felt surface is measured, the fiber orientation measuring device 71 is provided so as to face the surface.

It should be noted that in a case in which the fiber orientations of all layers are measured, a light source is provided which faces one of two surfaces of the paper, and the measuring device is provided which faces the opposite surface.

In this embodiment, the fiber orientation measuring device 71 is supported by a scanning unit which can move in a reciprocation manner in a cross direction of the paper machine 1. The fiber orientation measuring device 71 measures fiber orientation data while being moved by the scanning unit in order to measure an actual fiber orientation in a cross direction of the paper machine 1.

Figure 2:
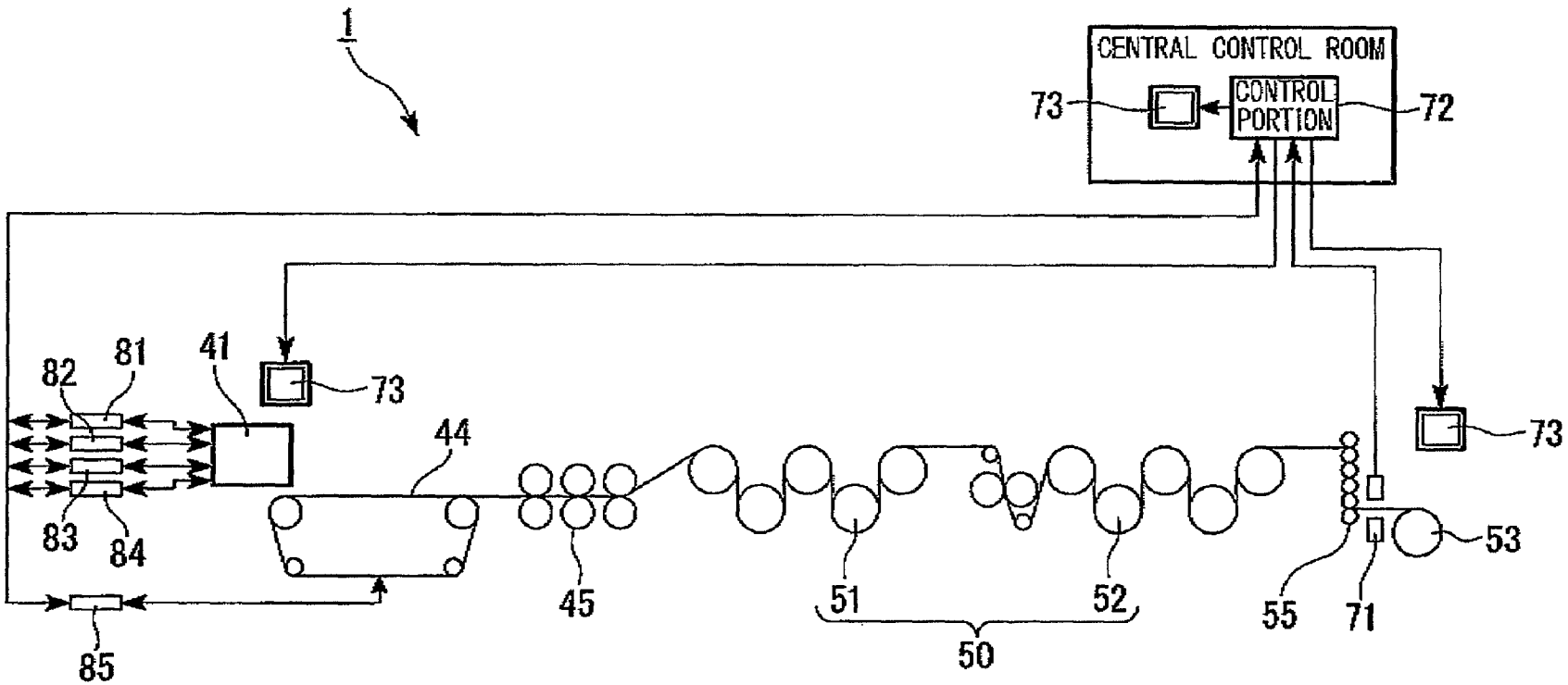
FIG. 2 is an outline constitutional drawing of a paper machine which includes a fiber orientation control simulation apparatus of one embodiment.

On the other hand, as shown in FIG. 2, the paper machine 1 has multiple manipulation portions. In addition, the paper machine 1 has a control portion 72 for controlling such multiple manipulation portions. Via the control portion 72, operations of a slice bolt manipulation portion 81, an edge flow valve manipulation portion 82, a side bleed valve manipulation portion 83 and other manipulation portions 84 and 85 are controlled.

The fiber orientation measuring device 71 provided just before the reel part 53 generates fiber orientation data of a surface of the paper by measuring and outputs the fiber orientation data to the control portion 72. The control portion 72 generates the actual fiber orientation profile based on the fiber orientation data and compares the actual fiber orientation profile to an ideal fiber orientation profile which is stored beforehand.

After this, based on a calculation result for controlling that is calculated by using a mathematical model, the control portion 72 controls operations of the slice bolt manipulation portion 81, the edge flow valve manipulation portion 82, the side bleed valve manipulation portion 83 and other manipulation portions 84 and 85 in order to adjust a slice lip opening, an edge flow valve opening, and the like. The control portion 72 conducts such a control operation so as to converge the actual fiber orientation profile at the ideal fiber orientation profile.

Figure 3:
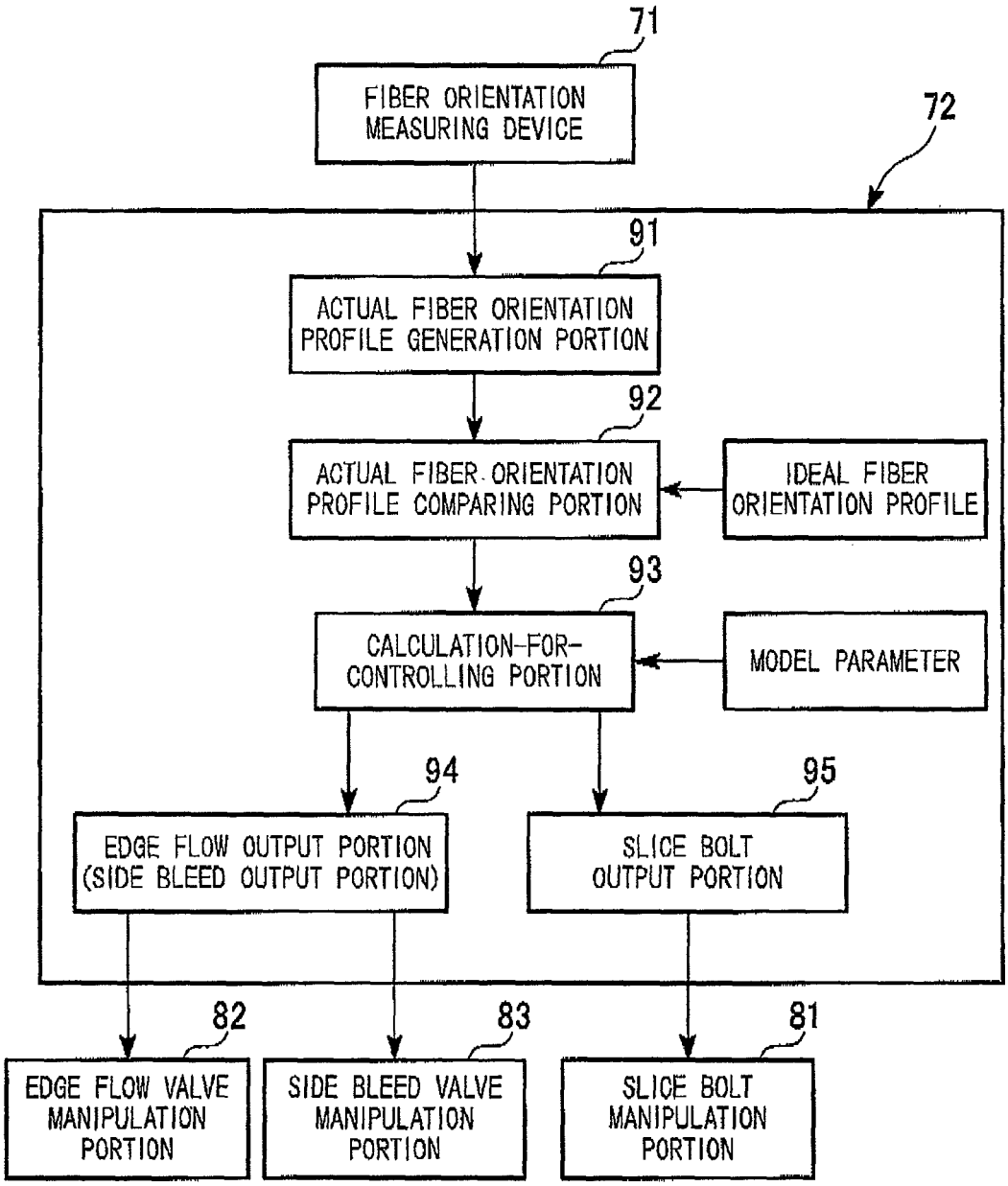
FIG. 3 is a block diagram showing an outline constitutional a fiber orientation control simulation apparatus of one embodiment.

For example, the control portion 72 as shown in FIG. 3 is provided at one place such as a central control room of a factory, and has a constitution including CPU as a main element. The fiber orientation data generated by the fiber orientation measuring device 71 is transmitted to the control portion 72. An actual fiber orientation profile generation portion 91 of the control portion 72 generates the actual fiber orientation profile based on the fiber orientation data.

After generating the actual fiber orientation profile, the actual fiber orientation profile is shown on a display apparatus 73 such as a CRT monitor connected to the control portion 72. On the other hand, the control portion 72 stores the ideal fiber orientation profile which is preferable for the paper produced by the paper machine 1 beforehand. The ideal fiber orientation profile is also shown on the display apparatus 73.

It should be noted that it is possible for the display apparatus 73 to display neither the actual fiber orientation profile nor the ideal fiber orientation profile. In such a case, it is possible for the control portion 72 to generate a fiber orientation deviation profile by calculating a difference between the actual fiber orientation profile and the ideal fiber orientation profile, and it is possible for the display apparatus 73 to display the fiber orientation deviation profile.

It should be noted that a position at which the display apparatus 73 is installed is not limited to the central control room, and it is possible to install the display apparatus 73 at a necessary position, for example, a position close to the headbox 41 or a position close to the fiber orientation measuring device 71.

After the above-described operation, a fiber orientation profile comparing portion 92 compares the actual fiber orientation profile to the ideal fiber orientation profile, and in addition, the fiber orientation profile comparing portion 92 calculates the fiber orientation deviation profile. Based on the fiber orientation deviation profile and a model parameter (coefficient) stored beforehand, a calculation-for-controlling portion 93 calculates a change of an operation amount.

The calculation-for-controlling portion 93 outputs the change of operation amount to both an edge flow output portion (side bleed output portion) 94 and a slice bolt output portion 95. The edge flow output portion (side bleed output portion) 94 inputs the change of operation amount and transmits information of the change of operation amount to the edge flow valve manipulation portion 82 (side bleed valve manipulation portion 83). Based on the information of the change of operation amount, the edge flow valve manipulation portion 82 adjusts openings of the edge flow valves 22 and 24. In addition, based on the information of the change of operation amount, the side bleed valve manipulation portion 83 adjusts openings of the side bleed valves 32 and 34.

In a similar manner, the slice bolt output portion 95 inputs the information of the change of operation amount and outputs the information of the change of operation amount to the slice bolt manipulation portion 81. Based on the information of the change of operation amount, the slice bolt manipulation portion 81 adjusts the opening of the slice lip 15.

The slice bolt manipulation portion 81 which is a slice-lip-opening adjusting unit, the edge flow valve manipulation portion 82 which is an edge flow adjusting unit, the side bleed valve manipulation portion 83 which is a side bleed adjusting unit, and the like, are connected to the control portion 72. It is possible to conduct an operation of transmitting and receiving predetermined data between such operation portions and the control portion 72.

Figure 4A:
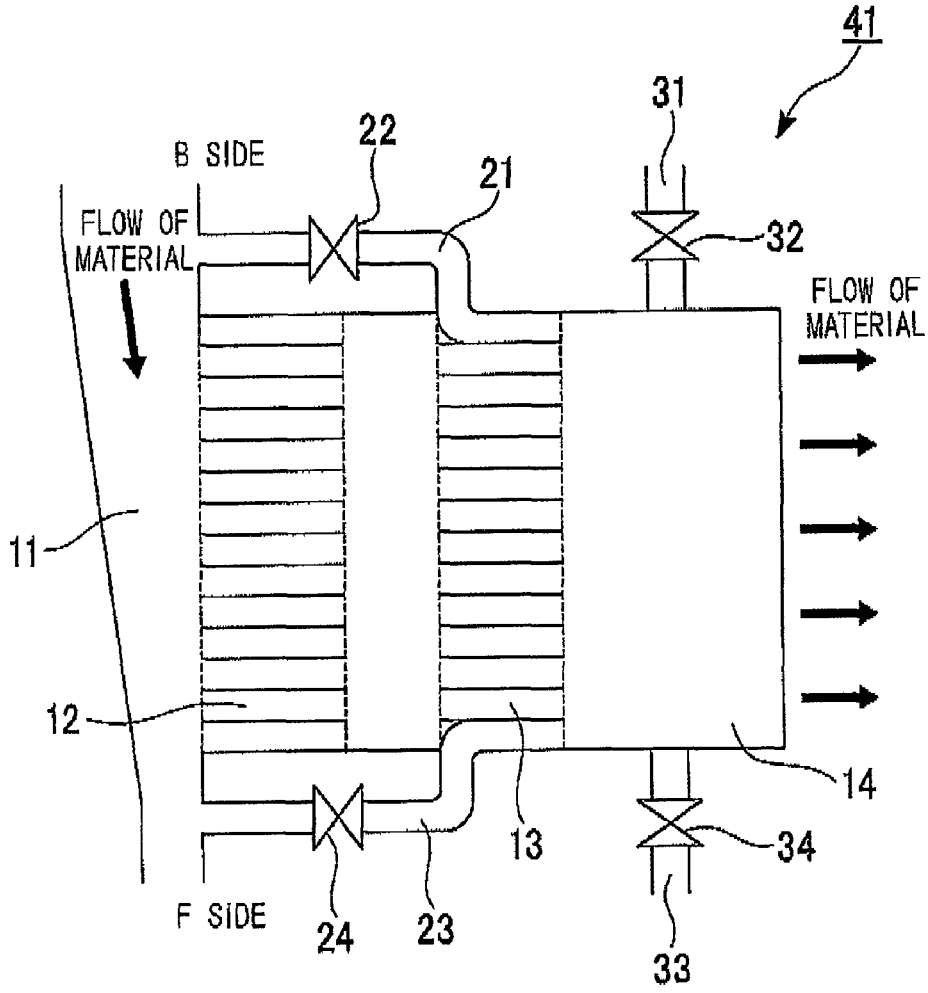
FIG. 4A is a plane figure showing a headbox of one embodiment.
Figure 4B:
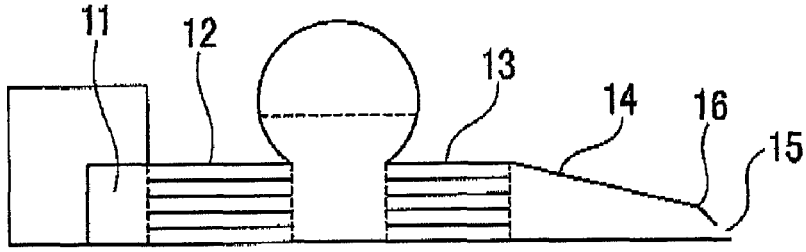
FIG. 4B is a cross-section of the headbox of one embodiment.

In addition, as shown in FIGS. 4A and 4B, the headbox 41 has both a taper header 11 to which the paper material is supplied and a tube bank 12 which adjusts a flow of the paper material. In a further downstream direction, the headbox 41 further has a turbulence generator 13 and a slice channel 14 which is constituted in a downstream direction from the turbulence generator 13. The slice lip 15 is constituted at an edge of the slice channel 14 that is an end of a flow direction of the paper material.

It should be noted that in this embodiment, a constitution is applied in which the paper material is discharged or supplied from the slice lip 15 to the wire part 44. Along an arrow in the drawing showing a flow of the paper material, a lower side along the arrow is called F (function) side, and an upper side is called B (actuation) side.

An edge flow pipe 21 (23) is connected to a side wall of the taper header 11 at one point of B side (F side). The taper header 11 and the turbulence generator 13 are connected via the edge flow pipes 21 and 23. Here, the taper header 11 and the turbulence generator 13 are connected not via the tube bank 12. In addition, an edge flow valve 22 (24) is provided in an intermediate portion of the edge flow pipe 21 (23). By adjusting the opening of the edge flow valve 22 (24), it is possible to adjust a velocity distribution at an exit of the turbulence generator 13, that is, it is possible to adjust a velocity distribution of the paper material discharged or supplied from the slice lip 15 to the wire part 44. The edge flow valve 22 and 24 are connected to the edge flow valve manipulation portion 82. Based on electric signals transmitted from the edge flow valve manipulation portion 82, the openings of the edge flow valves 22 and 24 are automatically adjusted.

In addition, a bleed pipe 31 (33) is connected to a side wall of the slice channel 14 at one point of B side (F side). Therefore, it is possible to discharge or supply the paper material inside the slice channel 14 from the bleed pipes 31 and 33. In addition, an side bleed valve 32 (34) is provided at the bleed pipe 31 (33). By adjusting the opening of the side bleed valve 32 (34), it is possible to adjust a velocity distribution at an exit of the slice lip 15. The side bleed valve 32 (34) is connected to the side bleed valve manipulation portion 83. Based on electric signals transmitted from the side bleed valve manipulation portion 83, the openings of the side bleed valve 32 (34) is automatically adjusted.

It should be noted that in general, one of the edge flow pipes 21/23 and the bleed pipes 31/33 is provided. However, it is possible to provide both the edge flow pipes 21/23 and the bleed pipes 31/33.

In addition, the slice bolts 16 are provided at an upper portion of the slice lip 15. By using the slice bolts 16, it is possible to adjust the opening of the slice lip 15 in a height direction. The slice bolts 16 are connected to the slice bolt manipulation portion 81. Based on electric signals transmitted from the slice bolt manipulation portion 81, the slice bolts 16 are automatically operated or activated, and the openings of the slice lip 15 in a height direction is adjusted. In addition, it is possible to adjust a portion of the slice bolts 16.

Operations are explained below.

First, the paper material is supplied to the headbox of the paper machine 1 and is discharged from or supplied out of the slice lip 15. After being dehydrated at the wire part 44, the supplied paper-material is transported to the press part 45. After being pressed for further squeezing the water by the press part 45, the paper material is transported to the dry part 50. The dry part 50 is divided into the pre-dryer 51 and the after-dryer 52. The dry part 50 dries the paper (paper material after squeezing the water) transported from the press part 45. The dried paper is strongly pressed by the calender part 55, and after this, the paper is reeled by the reel part 53.

Here, the fiber orientation measuring device 71 is provided just before the reel part 53. The fiber orientation measuring device 71 measures and generates fiber orientation data while moving in a cross direction of the paper machine 1 and transmits the fiber orientation data to the control portion 72. The control portion 72 receives the fiber orientation data. In the control portion 72, based on the fiber orientation data, the actual fiber orientation profile generation portion 91 generates the actual fiber orientation profile. The fiber orientation profile comparing portion 92 calculates a difference between the actual fiber orientation profile and the ideal fiber orientation profile, and in addition, the fiber orientation profile comparing portion 92 calculates the fiber orientation deviation profile. Here, the display apparatus 73 shows information which is necessary at an appropriate time.

The calculation-for-controlling portion 93 inputs the fiber orientation deviation profile calculated by the fiber orientation profile comparing portion 92 and determines whether or not a difference between the actual fiber orientation profile and the ideal fiber orientation profile is 0. If the difference is not 0, the calculation-for-controlling portion 93 calculates the change of operation amount applied to the slice bolts 16 and the edge flow valve 22/24 or applied to the slice bolts 16 and the side bleed valve 32/34. The edge flow output portion (side bleed output portion) 94 and slice bolt output portion 95 converts the data of the change of operation amount to electric signals and output the electric signals to the edge flow valve manipulation portion 82 (side bleed valve manipulation portion 83) and the slice bolt manipulation portion 81. In accordance with such an operation, each manipulation portion is adjusted. By repeatedly conducting the above-described operation, adjustment of each of the manipulation portions is conducted so as to converge the fiber orientation deviation profile at 0.

A constitution of a mathematical model of this embodiment and a calculation method of model parameters (coefficients) are explained. In this embodiment, the following definitions are applied in order to express the fiber orientation profile. A dividing operation (on the slice lip 15) in a cross direction of the paper is conducted to provide divided portions of N, and a measured value of the fiber orientation at each of the divided portions is FOPV(i). Here, "i" is an integer of 1-N. In a regular case, "N" is the number of slice bolts 16, and in an actual case, it is possible that each divided portion includes multiple slice bolts 16, and it is possible to calculate an average of the multiple slice bolts 16.

FOSV(i) is a desired value for controlling the fiber orientation that is controlled at a position corresponding to "i". There are various ways for expressing the fiber orientation, for example, an average value of all layers, a value of the felt surface, a value of the wire surface and a difference between values of the felt surface and the wire surface. However, here, the same way of expression is used for both the measured value of the fiber orientation FOPV(i) and the desired value for controlling the fiber orientation FOSV(i).

A formula (1) below defines a fiber orientation deviation FODV(i). An object of the operation is to make the fiber orientation deviation 0.

$$\mathrm{FODV}(i)=\mathrm{FOPV}(i)-\mathrm{FOSV}(i) \tag{1}$$

In this embodiment, a rate of change of each velocity component of the material at an exit of the slice lip 15 is calculated by using mathematical models, and a forecasting calculation of changes of the fiber orientation profile is conducted based on changes of the velocity components of the material. In addition, in this embodiment, the edge flow valves 22/24, the side bleed valves 32/34 and the slice bolt 16 are controlled so as to minimize a sum of squares of the fiber orientation deviation.

Figure 5:
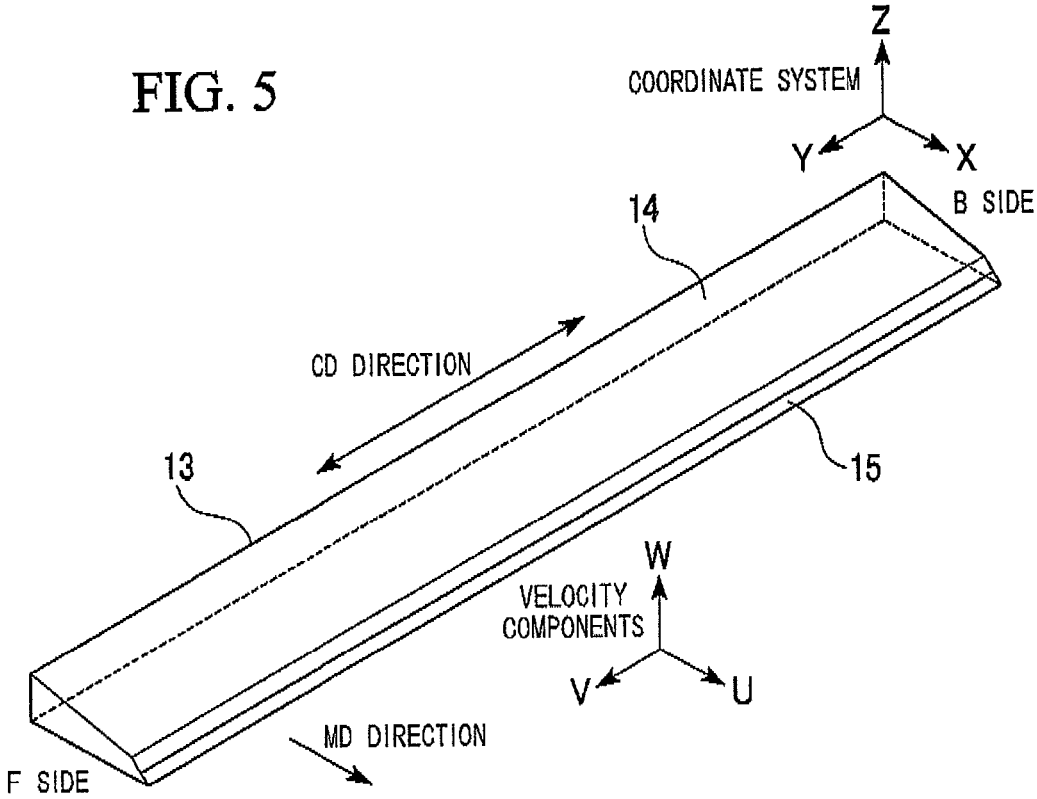
FIG. 5 is a constitutional drawing of a coordinate system.

In order to conduct such operations, as shown in FIG. 5, a coordinate system is defined. It should be noted that the same reference numerals as shown in FIG. 4 are assigned to the same constitutional elements, and detailed descriptions are omitted with regard to such constitutional elements. In FIG. 5, the slice lip 15 is provided in a downward direction from the slice channel 14, and the turbulence generator 13 is provided in an upward direction from the slice channel 14. In FIG. 5, the MD direction is a direction in which the paper is moved, and the CD direction is a widthwise direction of the paper.

Here, the coordinate X is defined in the MD direction, the coordinate Y is defined in the CD direction and the coordinate Z is defined in a thickness direction. Regarding the coordinate X, the direction in which the paper is moved is positive, and regarding the coordinate Y, the direction from the B side to the F side is positive. In such a coordinate system, a velocity component of a flow of the paper material in-the X direction is U (m/s), a velocity component in the Y direction is V (m/s) and a velocity component in the Z direction is W (m/s).

By using velocity components of the material at an exit of the slice lip 15, a fiber orientation calculated value FO(i) is defined as shown in the formula (2) below. It should be noted that "i" is an i-th area which is obtained by dividing the slice lip 15 into N areas in a cross direction of the paper.

The fiber orientation is affected by a dispersion or a difference of a hydration effect caused by the wire part 44 when forming a paper layer, a shrink in a cross direction caused by a drying operation of the dry part 50, and the like. However, it is possible to approximately express the fiber orientation by using the formula (2).

$$\mathrm{FO}(i)=\arctan(V(i)/U_R(i))\times 180/\pi \tag{2}$$

Here, V(i) is a velocity component (m/s) in a CD direction at an exit of an i-th area of the slice lip 15. $U_R(i)$ is a relative velocity component (m/s) of the i-th area in the MD direction. Regarding the orientation on the wire surface, a relative velocity is calculated from both a velocity of the material on the wire surface and a moving speed of the wire, and in addition, regarding the orientation on the felt surface, the relative velocity is the relative velocity between the velocity of the material and the paper layer just below the paper material on the felt surface. In accordance with the above-described formula (2), velocities of the material in both the MD direction and the CD direction are calculated, and it is possible to calculate the fiber orientation.

Formulas (3-1)-(3-3) show models of changes of velocity components U and V caused by manipulating the edge low valves 22/24 or the side bleed valves 32/34. Such models are called edge flow models.

[Formula 1]

$$dU_{EF}(i)=dU_{EB}(i)=0\ (1\le i\le N) \tag{3-1}$$

$$dV_{EF}(i)=\begin{cases}-\dfrac{L+1-i}{L}\times K_{EF}\times dEF & (i\le L)\\ 0 & (L<i)\end{cases} \tag{3-2}$$

$$dV_{EB}(i)=\begin{cases}\dfrac{i-(N-L)}{L}\times K_{EB}\times dEB & (N-L\le i)\\ 0 & (i<N-L)\end{cases} \tag{3-3}$$

"$dU_{EF}(i)$" of the formula (3-1) is a variation of the velocity component U at the i-th area when dEF % change is applied to the opening of one of the edge flow valve 24 on the F side and the side bleed valve 34 on the F side. "$dU_{EB}(i)$" is a variation of the velocity component U at the i-th area when dEB % change is applied to the opening of one of the edge flow valve 22 on the B side and the side bleed valve 32 on the B side. The formula (3-1) shows that the velocity component U does not have a change even if the openings of these valves are changed.

"$dV_{EF}(i)$" of the formula (3-2) is a variation of the velocity component V at the i-th area when dEF % change is applied to the opening of one of the edge flow valve 24 on the F side and the side bleed valve 34 on the F side. "$dV_{EB}(i)$" of the formula (3-3) is a variation of the velocity component V at the i-th area when dEB % change is applied to the opening of one of the edge flow valve 22 on the B side and the side bleed valve 32 on the B side. $K_{EF}/K_{EB}$ is a process gain of variation of the velocity component V observed when the opening of the valve on the F/B side is changed, and L is a response width.

Figure 6:
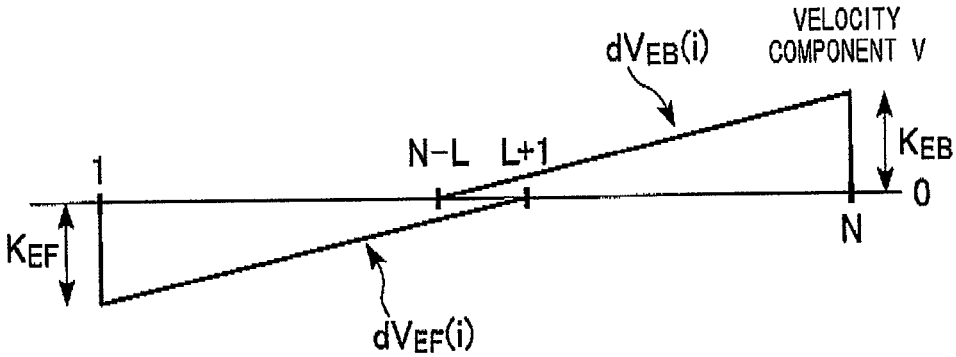
FIG. 6 is a drawing showing characteristics of $dV_{EF}(i)$ and $dV_{EB}(i)$ of one embodiment.

FIG. 6 shows $dV_{EF}(i)$ and $dV_{EB}(i)$ calculated by using formulas (3-2) and (3-3). A horizontal axis corresponds to a cross direction of the paper, and 1, N−L, L+1 and N respectively correspond to the first, (N−L)-th, (L+1)-th and N-th area. On the other hand, a vertical axis shows levels of $dV_{EF}(i)$ and $dV_{EB}(i)$.

$dV_{EF}(i)$ is the minimum value that is KEF When i=1, $dV_{EF}(i)$ is 0 when i=L+1, and $dV_{EF}(i)$ linearly moves between 1 and L+1. On the other hand, $dV_{EB}(i)$ is 0 When i=N−L, $dV_{EB}(i)$ is the maximum value that is KEB when i=N, and $dV_{EB}(i)$ linearly moves between N−L and N. In other words, it is possible to linearly change the velocity component from a side at which the edge flow pipes 21/23 or the side bleed pipes 31/33 are provided to a position of the L-th slice bolt 16.

It should be noted that in general, when the openings of the edge flow valves 22/24 are changed, the coefficients $K_{EF}/K_{EB}$ are positive. In addition, when the openings of the side bleed valves 32/34 are, changed, the coefficients $K_{EF}/K_{EB}$ are negative.

Variations of velocity components U and V when the opening of the slice lip 15 is changed by manipulating the slice bolt 16 are shown by using a model. Such a model is called a slice bolt model. A variation $dU_R(i)$ of the velocity component U is calculated by using the formula (4) below.

$$dU_R(i)=K_U=dS(i)\ (i=1,\ldots,N) \quad 4)$$

Here, dS(i) indicates changes in size of the open of the slice lip 15 corresponding to the i-th area, has an unit of μm and is a positive or negative value. In addition, $K_U$ is a process gain used for calculating a variation of the velocity component U based on the changes in size of the open of the slice lip 15, and is a positive or negative value.

By using formulas (5-1) to (5-5) below, it is possible to calculate a variation of the velocity component V. It should be noted that dT(i) indicates changes in size of the open of the slice lip 15 when the slice bolt 16 of the i-th area is manipulated. "r" is a range on which a moving average is calculated. KV is a process gain used for calculating a variation of the velocity component V based on the changes in size of the open of the slice lip 15.

[Formula 2]

$$dT(i) = dS(i-1) - dS(i+1)\ (i = 2, \ldots, N-1) \quad (5\text{-}1)$$

$$dT_m(i) = \frac{1}{2r+1}\sum_{k=-r}^{+r} dT(i+k) \quad (5\text{-}2)$$

$$\begin{aligned} dT_{mm}(i) &= \frac{1}{2r+1}\sum_{k=-r}^{+r} dT_m(i+k) \quad (5\text{-}3) \\ &= \frac{1}{(2r+1)^2}\{dS(i-(2r+1)) - dS(i+(2r+1))\} + \\ &\quad \frac{2}{(2r+1)^2}\left\{\sum_{k=1}^{2r} dS(i-k) - \sum_{k=1}^{2r} dS(i+k)\right\} \end{aligned}$$

$$dV_s(i) = K_v \times dT_{mm}(i) \quad (5\text{-}4)$$

First, by using the formula (5-1), a difference in cross direction dT(i) of the changes in size of the open of the slice lip 15 corresponding to the i-th area is calculated. After this, by using the formula (5-2), a moving average $dT_m(i)$ of a difference in cross direction of the changes in size of the open is calculated. The moving average is calculated with regard to an area which includes a center that is "i" and which has a range of ±r. After this, by using the formula (5-3), $dT_{mm}(i)$ which is a moving average of the moving average $dT_m(i)$ is calculated. In addition, by using $dT_{mm}(i)$ which is a moving average of the moving average, based on the formula (5-4), a variation $dV_s(i)$ caused in accordance with changes in size of the open of the slice lip 15 corresponding to the i-th area.

Figure 7A:
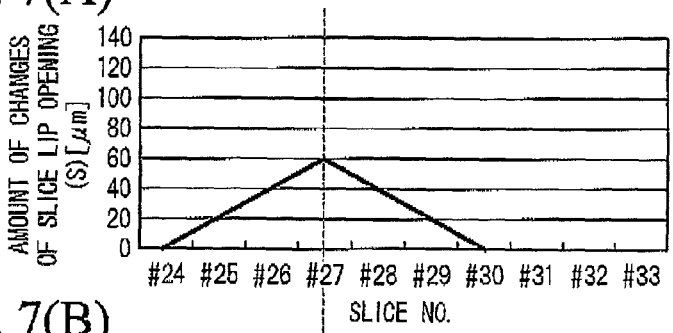
FIG. 7 is a graph showing characteristics when manipulating slice bolts in one embodiment. (A) is a graph showing amount of opening/closing a slice lip. (B) is a graph showing a relationship between dU and a variation of opening of a slice lip. (C) is a graph showing a relationship between dV, a moving average of differences of changes in size of the open of a slice lip and a moving average of a moving average of differences of changes in size of the open of a slice lip.
Figure 7B:
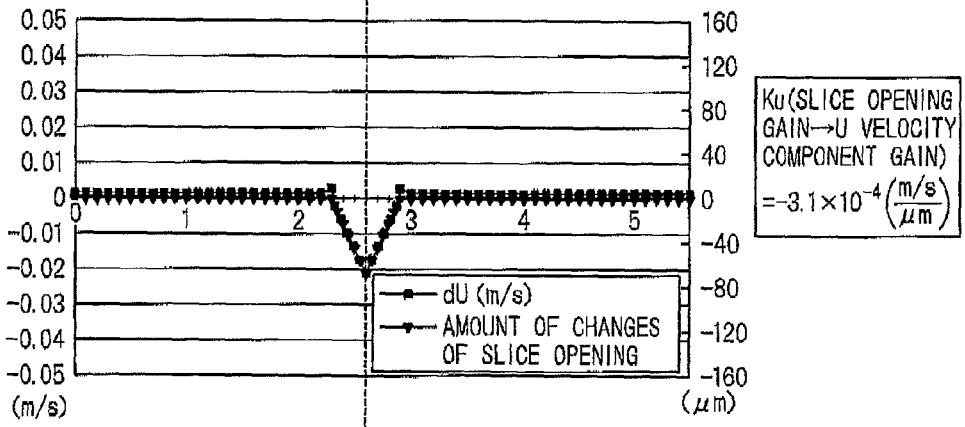
Figure 7C:
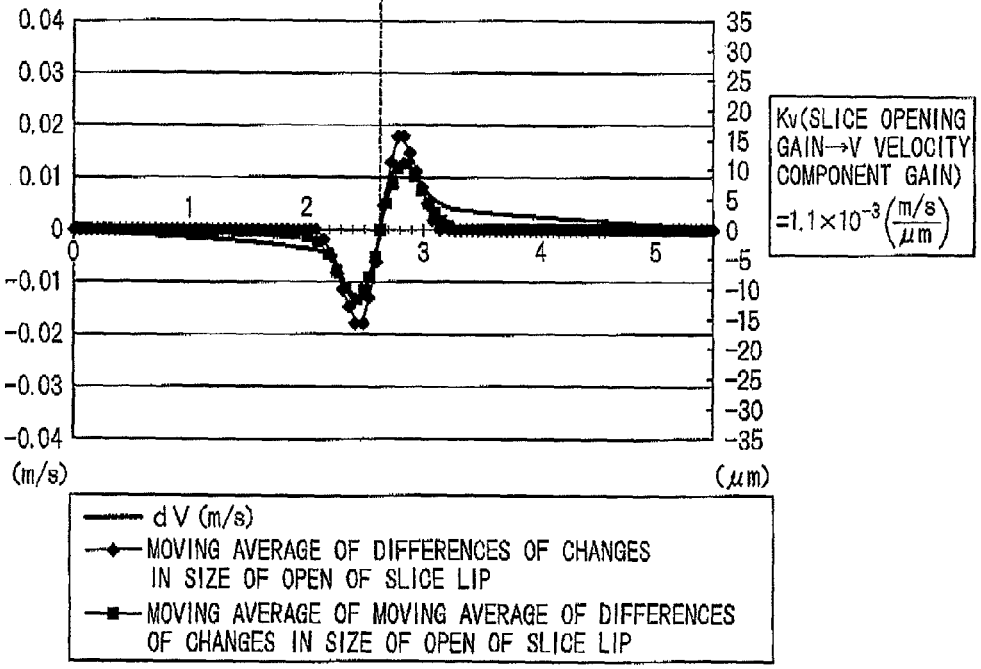

(A)-(C) of FIG. 7 show calculation results of changes of the velocity components U and V in a case of manipulating the slice bolts 16 based on the slice bolt model. The calculation results are obtained by using the formulas (4) and (5-1)-(5-4). It should be noted that in the formulas (5-2) and (5-3), "r=3" is applied.

(A) of FIG. 7 is a graph which roughly shows the changes in size of the open of the slice lip 15. In this graph, the opening of the slice lip 15 changes in a gabled line. (B) of FIG. 7 is a graph which shows both the changes in size of the open of the slice lip 15 and a change dU of the relative velocity U that is calculated by applying a fluid simulation. (C) of FIG. 7 is a graph which shows the moving average of the difference of the opening of the slice lip 15, the moving average of the moving average and a change dV of the relative velocity V that is calculated by applying a fluid simulation.

As shown in (B) and (C) of FIG. 7, a shape of the changes in size of the open of the slice lip 15 is similar to the change dU calculated by applying a fluid simulation, and the shape of the moving average of the moving average of the difference in a cross direction of the opening of the slice lip 15 is similar to the change dV calculated by applying a fluid simulation. Therefore, it is recognized that the slice bolt model is effective.

It should be noted that based on the dU and the changes in size of the open of the slice lip 15 shown in (B) of FIG. 7, a formula "$K_U=-3.1\times10^{-4}$ (m/s/μm)" is obtained. In addition, based on both the dV and the moving average of the moving average of differences in a cross direction of the changes in size of the open of the slice lip 15 shown in (C) of FIG. 7, a formula "$K_V=1.1\times10^{-3}$ (m/s/μm)" is obtained.

The fiber orientation of the i-th area is calculated based on the formula (2). By calculating a differential dFO(i) of the formula (2), it is possible to calculate changes of the fiber orientation. The formula (6) shown below shows the changes of the fiber orientation dFO(i).

[Formula 3]

$$\begin{aligned} dFO(i) &= \frac{180}{\pi}\times d\left(\arctan\left(\frac{V(i)}{U_R(i)}\right)\right) \quad (6) \\ &= \frac{180}{\pi}\times\left(\frac{\partial}{\partial U_R(i)}\left(\arctan\left(\frac{V(i)}{U_R(i)}\right)\right)\times dU_R(i) + \right. \\ &\quad \left. \frac{\partial}{\partial V(i)}\left(\arctan\left(\frac{V(i)}{U_R(i)}\right)\right)\times dV(i)\right) \\ &= \frac{180}{\pi}\times\left(\frac{-V(i)}{U_R(i)^2+V(i)^2}\times dU_R(i) + \right. \\ &\quad \left. \frac{U_R(i)}{U_R(i)^2+V(i)^2}\times dV(i)\right) \end{aligned}$$

Here, "$dU_R(i)$" is a change of the relative velocity component U (m/s) calculated by using the formula (4), dV(i) is a sum of changes of the velocity component V calculated by using formulas (3-2), (3-3) and (5-4) that is calculated by using a formula (7) shown below.

$$dV(i)=dV_S(i)+dV_{EF}(i)+dV_{EB}(i) \quad (7)$$

It should be noted that $U_R(i)$ is a current value (m/s) of the velocity component U, and V(i) is a current value (m/s) of the velocity component V. In addition, as shown in a formula (8) below, $U_R(i)$ which is a current value (m/s) of the velocity component U is obtained by calculating an integral of the formula (4).

$$U_R(i)=K_U\times S(i)+U_0\ (i=1,\ldots,N) \quad (8)$$

$U_0$ is an initial value of the relative velocity component U, is independent from the position i and, with regard to an average value of all layers, the felt surface and a differential orientation angle, is generally a negative value. In addition, with regard to the orientation angle of the wire surface, for example, by using J/W ratio, it is possible to approximately express $U_0$ by applying a formula (9) below.

$$U_0(i)=(R-A)\times WSPD\ (I=1,\ldots,N) \quad (9)$$

"R" is J/W ratio between the velocity component U of the paper material on the paper layer of the wire surface and the moving velocity of the wire. "A" is a certain value close to 1.00. "WSPD" is the moving velocity of the wire.

As shown in a formula (10) below, after calculating V(i) based on the formula (2), it is possible to calculate a current value of the velocity component V by replacing the fiber orientation calculated value FO(i) with the measured value of the fiber orientation FOPV(i).

$$V(i)=\tan(\mathrm{FOPV}(i)\times\pi/180)\times U_R(i) \tag{10}$$

$U_R(i)$ is a current value of the relative velocity component U.

A relationship between the velocity components U and V is shown by the formula (2). Therefore, in accordance with both the edge flow model and the slice bolt model, it is recognized that, when manipulating edge flow valves 22/24, side bleed valves 32/34 and the slice bolt 16, changes of the fiber orientation have the following characteristics. It should be noted that an average value FOAVE of the fiber orientation profile is a value expressed by the formula (11) below.

[Formula 4]

$$FOAVE=\left(\sum_{i=1}^{N} FOPV(i)\right)\Big/N \tag{11}$$

FOPV(i) is a measured value of the fiber orientation at the position i.

It is recognized from FIG. 6 that, when manipulating edge flow valves 22/24 and side bleed valves 32/34, it is possible to modify an average value of the fiber orientation profile by manipulating the valves on the F side and B side in opposite directions. In addition, it is possible to change the shape of the fiber orientation profile while the change has a width as large as the response width L.

Compared to such characteristics, as clearly shown in FIG. 7 and formulas (5-1)-(5-4), the average value of the fiber orientation profile has almost no change when manipulating the slice bolt 16. However, by manipulating the slice bolt 16, it is possible to locally or partially change the fiber orientation profile.

In accordance with such characteristics, by combining manipulation of edge flow valves 22/24, side bleed valves 32/34 and the slice bolt 16, it is possible to cause an overall change on a shape of the fiber orientation profile, and it is possible to adjust the average value of the fiber orientation so as to be close to 0°. However, there is a possibility that there may be cases in which the edge flow valves 22/24 or the side bleed valves 32/34 are alternatively manipulated.

It is possible to calculate the fiber orientation deviation FODV(i) at the position i by applying the formula (1). Therefore, a sum of squares J of the fiber orientation deviation that is shown by the formula (12) is used.

[Formula 5]

$$J=\sum_{i=1}^{N} FODV(i)^2 \tag{12}$$

As shown below, regarding a case of adjusting operation means that are the slice bolt 16 and the edge flow valves 22/24 or side bleed valves 32/34, a control method has been studied to optimize the evaluation function which is expressed by (12). For such an optimization, the formulas (4) and (5-4) are assigned to the formula (6), and a change of the fiber orientation profile, that is dFO(i), is calculated. The formula (13) below shows the results.

[Formula 6]

$$\begin{aligned} dFO(i) = {} & \frac{180}{\pi}\times\left(\frac{-V(i)}{U_R(i)^2+V(i)^2}\times dU_R(i)+\frac{U_R(i)}{U_R(i)^2+V(i)^2}\times dV(i)\right)= \\ & \frac{-180V(i)\times K_U}{\pi(U_R(i)^2+V(i)^2)}\times dS(i)+ \\ & \frac{180U_R(i)\times K_V}{\pi(U_R(i)^2+V(i)^2)\times(2r+1)^2}\times\left\{dS(i-(2r+1))-\right. \\ & \left. dS(i+(2r+1))+2\sum_{k=1}^{2r}(dS(i-k)-dS(i+k))\right\}+ \\ & \frac{180U_R(i)}{\pi(U_R(i)^2+V(i)^2)}\times(dV_{EF}(i)+dV_{EB}(i)) \end{aligned} \tag{13}$$

The formula (14) is obtained by rewriting the formula (13) as a matrix.

[Formula 7]

$$\begin{bmatrix} dFO(1) \\ dFO(2) \\ \vdots \\ dFO(N) \end{bmatrix} = K \begin{bmatrix} dS(1) \\ dS(2) \\ \vdots \\ dS(N) \\ dEF \\ dEB \end{bmatrix} \tag{14}$$

It should be noted that $K=[K^S\ K^E]$

"$K^S$" of the formula (14) is an N×N matrix which shows a change of the fiber orientation profile caused by changing the opening of the slice lip 15. The value of $K^S$ is calculated based on a formula (15) below. In addition, $K^E$ is a matrix of N×2 which shows a change of the fiber orientation profile caused by changing the openings of the edge flow valves 22/24 or the side bleed valves 32/34. A value of $K^E$ is calculated based on a formula (16) below.

[Formula 8]

$$\begin{aligned} & K^s=(K^s_{i,j})\ (1\le i\le N,\ 1\le j\le N) \\ & K^s_{i,j}=0\ (\text{when } j<i-(2r+1)) \\ & K^s_{i,j}=\frac{180}{\pi}\times\frac{U_R(i)\times K_V}{(2r+1)^2\times(U_R(i)^2+V(i)^2)} \\ & (\text{when } j=i-(2r+1)) \\ & K^s_{i,j}=\frac{180}{\pi}\times\frac{2U_R(i)\times K_V}{(2r+1)^2\times(U_R(i)^2+V(i)^2)} \\ & (\text{when } i-2r\le j<i) \\ & K^s_{i,j}=\frac{180}{\pi}\times\frac{2U_R(i)\times K_V}{(2r+1)^2\times(U_R(i)^2+V(i)^2)} \\ & (\text{when } i-2r\le j<i) \\ & K^s_{i,j}=\frac{180}{\pi}\times\frac{-V(i)\times K_U}{U_R(i)^2+V(i)^2}\ (\text{when } j=i) \\ & K^s_{i,j}=\frac{180}{\pi}\times\frac{-2U_R(i)\times K_V}{(2r+1)^2\times(U_R(i)^2+V(i)^2)} \\ & (\text{when } i<j\le i+2r) \\ & K^s_{i,j}=\frac{180}{\pi}\times\frac{-U_R(i)\times K_V}{(2r+1)^2\times(U_R(i)^2+V(i)^2)} \end{aligned} \tag{15}$$

-continued (when $i+(2r+1)=j$)

$K^s_{i,j}=0$ (when $i+(2r+1)<j$)

[Formula 9]

$$K^E=(K^E_{i,j})\ (1\le i\le N,\ j=1,2) \tag{16}$$

$$K^E_{i,1}=\frac{180}{\pi}\times\frac{U_R(i)\times K_{EF}}{(U_R(i)^2+V(i)^2)}\times\left(-\frac{L+1-i}{L}\right)$$

(when $i\le L$).

$K^E_{i,1}=0$ (when $i>L$)

$$K^E_{i,2}=\frac{180}{\pi}\times\frac{U_R(i)\times K_{EB}}{(U_R(i)^2+V(i)^2)}\times\left(\frac{i-(N-L)}{L}\right)$$

(when $N-L\le i$)

$K^E_{i,2}=0$ (when $i<N-L$)

Here, a formula (17) is obtained by calculating an integral of the formula (14).

[Formula 10]

$$\underline{FOPV}=K\times\underline{S}+\underline{FOPV_0} \tag{17}$$

It should be noted.

$$\underline{FOPV}=\begin{bmatrix}FO(1)\\FO(2)\\\vdots\\FO(N)\end{bmatrix},\ \underline{S}=\begin{bmatrix}S(1)\\S(2)\\\vdots\\S(N)\\EF\\EB\end{bmatrix},$$

$\underline{FOPV_0}$ = Initial value of $\underline{FOPV}$

By assigning the formula (17) to the formula (12), the evaluation function J is expressed by the formula (18) below.

[Formula 11]

$$\begin{aligned}J&=\sum_{i=1}^{N}FODV(i)^2\\&=\underline{FODV}^t\times\underline{FODV}\\&=(\underline{FOPV}-\underline{FOSV})^t\times(\underline{FOPV}-\underline{FOSV})\\&=(K\times\underline{S}+\underline{FOPV_0}-\underline{FOSV})^t\times\\&\quad(K\times\underline{S}+\underline{FOPV_0}-\underline{FOSV})\\&=\underline{S}^tK^t\times K\underline{S}+2\underline{S}^tK^t\times(\underline{FOPV_0}-\underline{FOSV})+\\&\quad(\underline{FOPV_0}-\underline{FOSV})^t\times(\underline{FOPV_0}-\underline{FOSV})\end{aligned} \tag{18}$$

Here, $$\underline{FOSV}=\begin{bmatrix}FOSV(1)\\FOSV(2)\\\vdots\\FOSV(N)\end{bmatrix},\ \underline{FODV}=\begin{bmatrix}FODV(1)\\FODV(2)\\\vdots\\FODV(N)\end{bmatrix},$$

-continued

[Formula 12]

$$\nabla J=\left[\frac{\partial J}{\partial S(1)}\ \frac{\partial J}{\partial S(2)}\ \cdots\ \frac{\partial J}{\partial S(N)}\ \frac{\partial J}{\partial EF}\ \frac{\partial J}{\partial EB}\right]^t$$

By applying a definition above, the formula (19) is obtained based on the formula (18).

[Formula 13]

$$\begin{aligned}\nabla J&=2K^t\times K\underline{S}+2K^t\times(\underline{FOPV_0}-\underline{FOSV})\\&=2K^t\times(\underline{FOPV}-\underline{FOPV_0})+2K^t\times(\underline{FOPV_0}-\underline{FOSV})\\&=2K^t\times(\underline{FOPV}-\underline{FOSV})\\&=2K^t\times\underline{FODV}\end{aligned} \tag{19}$$

An operation amount of changes in size of opening/closing the slice lip 15 and the edge flow valves 22/24 or the side bleed valves 32/34, that are manipulated at a next step, are expressed in a formula (20) by using a positive value $\epsilon$.

[Formula 14]

$$d\underline{S}=-\frac{\varepsilon}{2}\nabla J\ (\varepsilon>0) \tag{20}$$

In accordance with the method of steepest descent, the formula (20) shows a change of operation amount that causes the most steeply dropping result of the evaluation function J. "$\epsilon$" corresponds to an operation gain. By assigning the formula (19) to the formula (20), a formula (21) below is obtained.

[Formula 15]

$$dS=-\epsilon\times K^t\times\mathrm{FODV} \tag{21}$$

A formula (22) below is obtained by modifying the formula (21). $K^S$ and $K^E$ are obtained based on the formulas (15) and (16).

[Formula 16]

$$d\underline{S}=-\varepsilon\times[K^S\ \ K^E]^t\times\underline{FODV}=-\varepsilon\times\begin{bmatrix}(K^S)^t\times\underline{FODV}\\(K^E)^t\times\underline{FODV}\end{bmatrix} \tag{22}$$

The formula (23) below is obtained by modifying the formula (22).

[Formula 17]

$$\begin{bmatrix}dS(1)\\dS(2)\\\vdots\\dS(N)\end{bmatrix}=-\varepsilon\times(K^S)^t\times\underline{FODV},\quad\begin{bmatrix}dEF\\dEB\end{bmatrix}=-\varepsilon\times(K^E)^t\times\underline{FODV} \tag{23}$$

In practical cases, the formula (24) below is obtained by dividing the operation gain a of the formula (23) into an operation gain of the slice bolt 16 and an operation gain of the edge flow valves 22/24 or the side bleed valves 32/34.

[Formula 18]

$$\begin{bmatrix} dS(1) \\ dS(2) \\ \vdots \\ dS(N) \end{bmatrix} = -\varepsilon^S \times (K^S)^t \times \underline{FODV}, \quad (24)$$

$$\begin{bmatrix} dEF \\ dEB \end{bmatrix} = -\varepsilon^E \times (K^E)^t \times \underline{FODV}$$

It should be noted that $\epsilon^S$ is an operation gain of the opening of the slice lip 15, and $\epsilon^B$ is an operation gain of the edge flow valves 22/24 or the side bleed valves 32/34.

In order to optimize the evaluation function J defined by the formula (12), a change of operation amount defined by the formula (24) is used as a change of operation amount for conducting the fiber orientation control by adjusting operation means, that are, the slice bolt 16 and the edge flow valves 22/24 or side bleed valves 32/34.

Figure 8A:
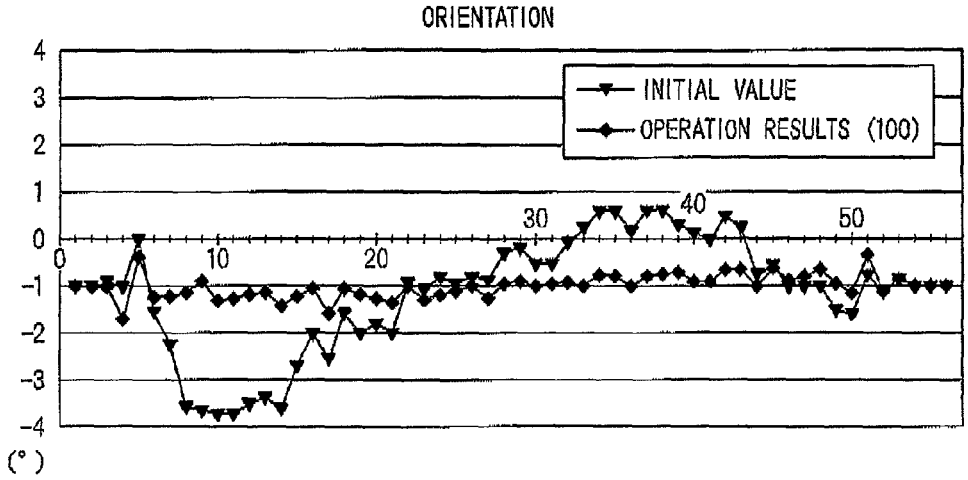
FIG. 8A is a drawing which shows simulation results of both an initial value and operation results (100 times) obtained by manipulating only slice bolts in one embodiment, and which shows an orientation at each point along a cross direction of a slice lip.
Figure 8B:
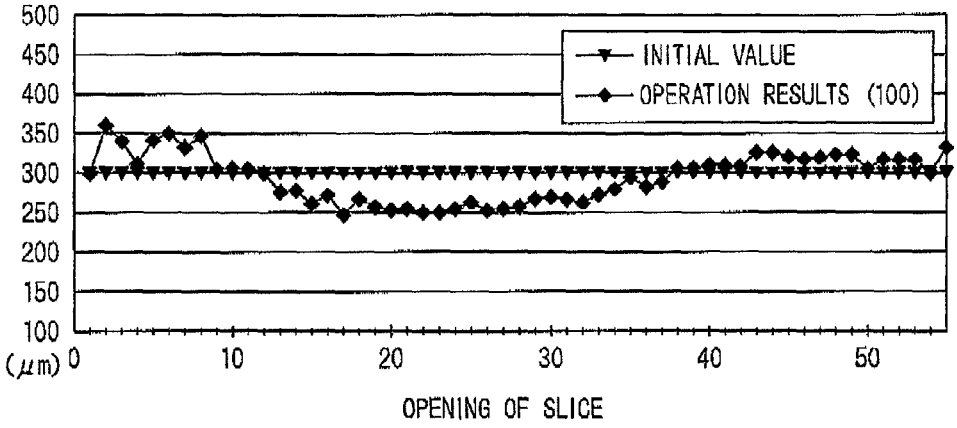
FIG. 8B is a drawing which shows simulation results of both an initial value and operation results (100 times) obtained by manipulating only slice bolts in one embodiment, and which shows an opening at each point along a cross direction of a slice lip.

FIGS. 8A and 8B show simulation results of a case in which only the slice bolt 16 is manipulated. Here, a precondition of the desired value for controlling the fiber orientation FOSV(i)=0 and N=56 is applied, and an initial value is set to the measured value of the fiber orientation FOPV(i). It should be noted that i=1–N.

In addition, the process gain, and the like, are set as shown below.

$K_U$=−0.0003((m/s)/μm)

$K_V$=0.0006((m/s)/μm)

$K_{EF}$=0.0015((m/s)/%)

$K_{EB}$=0.0019((m/s)/%)

$\epsilon^S$=20(μm/°)

$\epsilon^E$=0(%/°)

A range of moving average: r=1

Simulation: 100 times

An average value of initial values of the measured value profile of the fiber orientation is −1° that shows a distribution of the fiber orientation at each point on the slice lip 15 in a cross direction. In accordance with FIG. 8A, by manipulating only the slice bolt 16, the measured value of the fiber orientation converges at the same value as the average value of the initial values. In addition, FIG. 8B shows the opening of the slice lip 15 in a cross direction when the results shown in FIG. 8A are observed.

Figure 9:
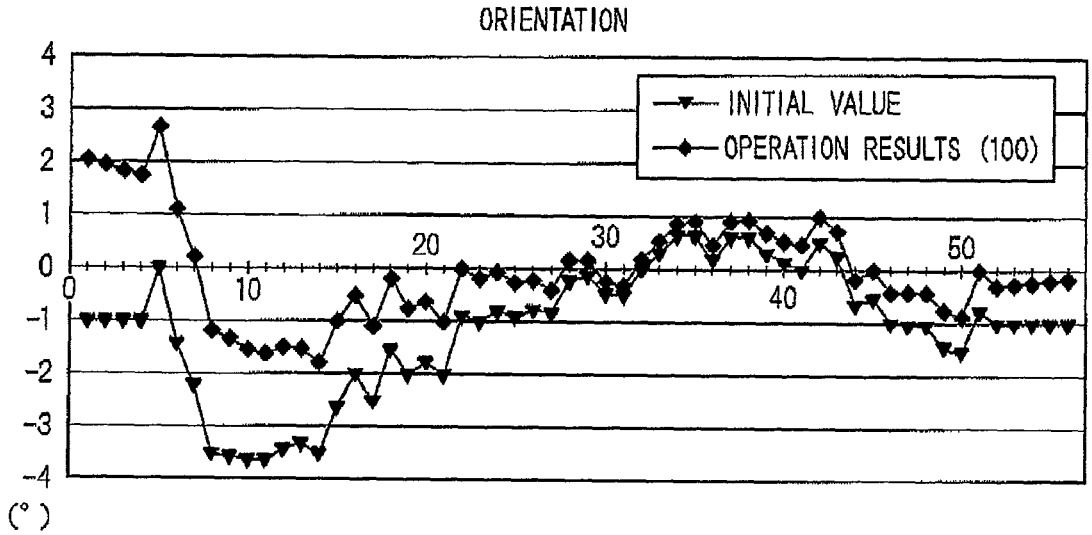
FIG. 9 is a drawing which shows simulation results of both an initial value and operation results (100 times) obtained by manipulating only an edge flow valve observed at each point along a cross direction of a slice lip in one embodiment.

FIG. 9 shows simulation results in a case in which only edge flow valves 22/24 are manipulated. $K_U$, $K_V$, $K_{EF}$, $K_{EB}$, r and time of simulation are the same as FIG. 5. $\epsilon^S$ and $\epsilon^E$ are as shown below.

$\epsilon^S$=0(μm/°)

$\epsilon^E$=0.01(%/°)

In addition, initial values of operation amount of the edge flow valves 22/24 are as shown below.

EF=EB=60%

Final values of an operation amount of the edge flow valves 22/24 are as shown below.

EF=54.1%, EB=61.3%

It is recognized by referring to FIG. 6 that it is possible to adjust the average value of the measured value profile of the fiber orientation so as to be close to 0° by manipulating only the edge flow valves 22/24. However, in general, it is not possible to adjust the value of the fiber orientation profile at each point so as to be close to 0°.

Figure 10A:
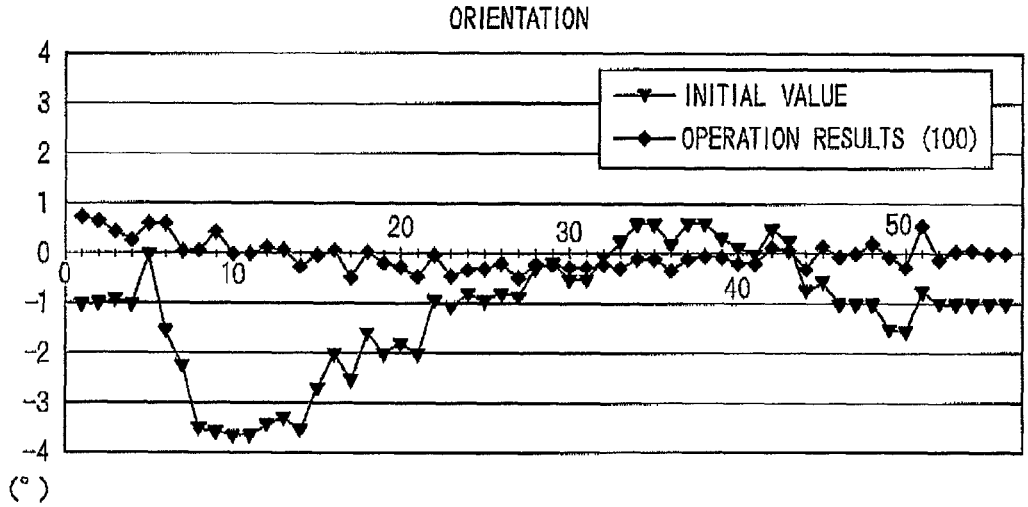
FIG. 10A is a drawing which shows simulation results of both an initial value and operation results (100 times) obtained by manipulating both slice bolts and an edge flow valve in one embodiment, and which shows an orientation at each point along a cross direction of a slice lip.
Figure 10B:
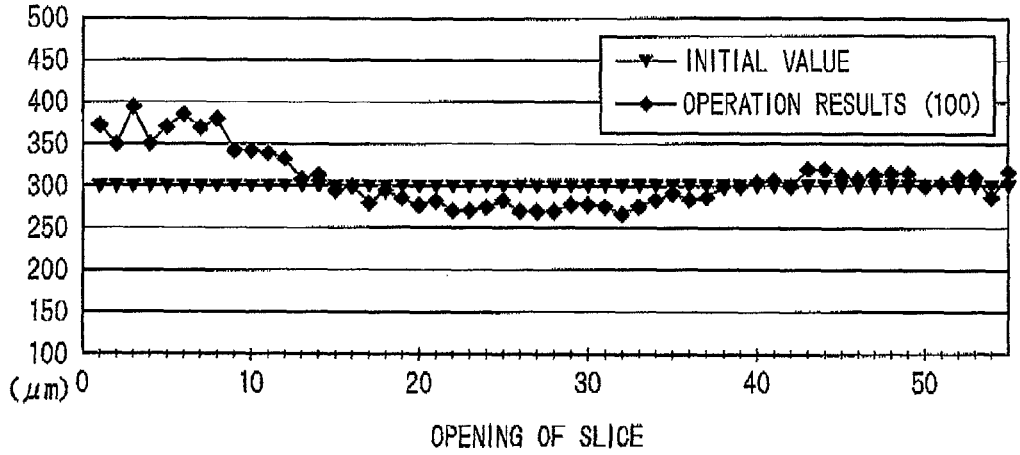
FIG. 10B is a drawing which shows simulation results of both an initial value and operation results (100 times) obtained by manipulating both slice bolts and an edge flow valve in one embodiment, and which shows an opening at each point along a cross direction of a slice lip

FIGS. 10A and 10B show simulation results obtained by controlling both the slice bolt 16 and the edge flow valves 22/24. $K_U$, $K_V$, $K_{EF}$, $K_{EB}$, r and time of simulation are the same as FIG. 6. $\epsilon^S$ and $\epsilon^E$ are as shown below.

$\epsilon^S$=20(μm/°)

$\epsilon^E$=0.0(%/°)

In addition, initial values of the operation amount of the edge flow valves 22/24 are as shown below.

EF=EB=60%

Final values of the operation amount of the edge flow valves 22/24 are as shown below.

EF=56.7%, EB=61.6%

It is recognized by referring to FIG. 10A that it is possible to adjust the fiber orientation deviation FODV(i) at each point so as to be close to 0 by controlling both the slice bolt 16 and the edge flow valves 22/24. In addition, FIG. 10B shows the opening of the slice lip 15 in a cross direction when the results shown in FIG. 10A are observed.

In accordance with this embodiment, it is possible to provide a mathematical model and model parameters to conduct a forecasting calculation of changes of the fiber orientation profile caused by adjusting the edge flow (side bleed) and the opening of the slice lip.

In addition, by inputting a difference between the measured value of the fiber orientation and the desired value for controlling the fiber orientation to the calculation-for-controlling portion, it is possible to quantitatively calculate the operation amount of each manipulation portion that is used for controlling the fiber orientation, and hence, it is possible to achieve a preferable control. In addition, by successively conducting such a control, it is possible to converge the measured value of the fiber orientation at the desired value for controlling the fiber orientation.

It is possible to adjust the average value of the measured value profile of the fiber orientation so as to be close to 0° by manipulating the edge flow valves and/or the side bleed valves, and hence, it is possible to produce paper of high quality.

In addition, by locally or partially controlling the opening of the slice bolt, it is possible to locally or partially adjust the fiber orientation so as to be close to'a desired value.

Therefore, it is possible to adjust an average of the fiber orientation so as to be close to 0° by controlling both the opening of the slice lip and the openings of the edge flow valves and/or the side bleed valves, and in addition, by local or partial adjustments, it is possible to adjust an average of the fiber orientation so as to be close to 0°, hence, it is possible to produce paper of higher quality.

It should be noted that the embodiments above are not limitations for the invention of the present application, and for example, it is possible to apply such modifications shown below.

In the above embodiments, a case of providing the fiber orientation measuring device is provided just before the reel part is explained, but it is possible to provide the fiber orientation measuring device at a position between the pre-dryer and the after-dryer.

In addition, in a case in which it is not necessary to achieve uniformity of the fiber orientation of both front and back sides because of a level of requested paper quality, with regard to one of the felt surface and wire surface, it is possible to measure only one of the fiber orientation and the average of the fiber orientation of all layers.

The above described embodiments explain a case of adjusting a difference so as to be 0 between the actual fiber orientation profile and the ideal fiber orientation profile, and it is possible to apply the present invention to a case of adjusting a difference so as to be 0 between the actual fiber orientation profiles of a front side and back side of the paper.

INDUSTRIAL APPLICABILITY

A paper machine is realized which can control the fiber orientation with high accuracy.

The invention claimed is:

1. A fiber orientation control method characterized by comprising the steps of:

expressing changes of velocity components of a paper material at an exit of a slice lip by using a mathematical model, wherein the changes of velocity components are caused by manipulating at least one of an edge flow adjustment means and a side bleed adjustment means of a headbox when supplying the paper material on a wire;

setting the mathematical model based on an assumption in which a velocity component orthogonally crossing a flow direction of the paper material is proportionally changed by at least one of changes of an edge flow and a side bleed of a certain response width from the exit of the slice lip; and based on an evaluation function calculated by using a forecasting calculation means which calculates changes of a fiber orientation profile in a cross direction in accordance with the mathematical model, calculating at least one of an operation amount of an edge flow and an optimized operation amount of a side bleed.

2. A fiber orientation control method characterized by comprising the steps of:

expressing changes of velocity components of a paper material at an exit of a slice lip by using a mathematical model, wherein the changes of velocity components are caused by manipulating a slice-lip-opening-adjusting means of a headbox when supplying the paper material on a wire;

setting the mathematical model based on an assumption in which a velocity component in a flow direction of the paper material is proportionally changed in accordance with changes in size of an open of the slice lip and in which a velocity component orthogonally crossing the flow direction of the paper material is proportionally changed in accordance with an average value of differences of changes in size of an open in a cross direction of the slice lip; and based on an evaluation function calculated by using a forecasting calculation means which calculates changes of a fiber orientation profile in a cross direction in accordance with the mathematical model, calculating an operation amount of opening/closing the slice lip.

3. A fiber orientation control method characterized by comprising the steps of:

expressing changes of velocity components of a paper material at an exit of a slice lip by using a mathematical model, wherein the changes of velocity components are caused by manipulating a slice-lip-opening-adjusting means and at least one of an edge flow adjustment means and a side bleed adjustment means of a headbox when supplying the paper material on a wire;

setting the mathematical model based on an assumption in which a velocity component in a flow direction of the paper material is proportionally changed in accordance with changes in size of an open of the slice lip and in which a velocity component orthogonally crossing the flow direction of the paper material is a sum of both changes proportional to an average value of differences of changes in size of an open in a cross direction of the slice lip and changes proportional to changes of at least one of an edge flow and a side bleed of a certain response width from the exit of the slice lip; and based on an evaluation function calculated by using a forecasting calculation means which calculates changes of a fiber orientation profile in a cross direction in accordance with the mathematical model, calculating an operation amount of opening/closing the slice lip and at least one of an operation amount of an edge flow and an optimized operation amount of a side bleed.

4. A fiber orientation control method according to any one of claims 1-3, wherein a sum of squares of control deviation is applied to the evaluation function for calculating the optimized operation amount of opening/closing the slice lip and at least one of the optimized operation amount of the edge flow and the optimized operation amount of the side bleed.

5. A fiber orientation control method according to claim 4, wherein a method of steepest descent is applied with regard to the evaluation function for calculating the optimized operation amount of opening/closing the slice lip and at least one of the optimized operation amount of the edge flow and the optimized operation amount of the side bleed.

6. A fiber orientation control apparatus characterized by comprising the steps of:

expressing changes of velocity components of a paper material at an exit of a slice lip by using a mathematical model, wherein the changes of velocity components are caused by manipulating at least one of an edge flow adjustment means and a side bleed adjustment means of a headbox when supplying the paper material on a wire;

setting the mathematical model based on an assumption in which a velocity component orthogonally crossing a flow direction of the paper material is proportionally changed by at least one of changes of an edge flow and a side bleed of a certain response width from the exit of the slice lip; and based on an evaluation function calculated by using a forecasting calculation means which calculates changes of a fiber orientation profile in a cross direction in accordance with the mathematical model, calculating at least one of an operation amount of an edge flow and an optimized operation amount of a side bleed;

based on at least one of the optimized operation amount of the edge flow and the optimized operation amount of the side bleed, adjusting at least one of the edge flow adjustment means and the side bleed adjustment means.

7. A fiber orientation control apparatus characterized by comprising the steps of:

expressing changes of velocity components of a paper material at an exit of a slice lip by using a mathematical model, wherein the changes of velocity components are caused by manipulating a slice-lip-opening-adjusting means of a headbox when supplying the paper material on a wire;

setting the mathematical model based on an assumption in which a velocity component in a flow direction of the paper material is proportionally changed in accordance with changes in size of an open of the slice lip and in which a velocity component orthogonally crossing the flow direction of the paper material is proportionally changed in accordance with an average value of differences of changes in size of an open in a cross direction of the slice lip;

based on an evaluation function calculated by using a forecasting calculation means which calculates changes of a fiber orientation profile in a cross direction in accordance with the mathematical model, calculating an operation amount of opening/closing the slice lip; and based on the optimized operation amount of opening/closing the slice lip, adjusting the slice-lip-opening-adjustment means and the side bleed adjustment means.

8. A fiber orientation control apparatus characterized by comprising the steps of:

expressing changes of velocity components of a paper material at an exit of a slice lip by using a mathematical model, wherein the changes of velocity components are caused by manipulating a slice-lip-opening-adjusting means and at least one of an edge flow adjustment means and a side bleed adjustment means of a headbox when supplying the paper material on a wire;

setting the mathematical model based on an assumption in which a velocity component in a flow direction of the paper material is proportionally changed in accordance with changes in size of an open of the slice lip and in which a velocity component orthogonally crossing the flow direction of the paper material is a sum of both changes proportional to an average value of differences of changes in size of an open in a cross direction of the slice lip and changes proportional to changes of at least one of an edge flow and a side bleed of a certain response width from the exit of the slice lip;

based on an evaluation function calculated by using a forecasting calculation means which calculates changes of a fiber orientation profile in a cross direction in accordance with the mathematical model, calculating an operation amount of opening/closing the slice lip and an operation amount of at least one of an edge flow and a side bleed; and based on the operation amount of opening/closing the slice lip and at least one of the operation amount of the edge flow and the operation amount of the side bleed, adjusting the slice-lip-opening-adjustment means and at least one of the edge flow adjustment means and the side bleed adjustment means.

9. A fiber orientation control apparatus according to any one of claims 6-8, wherein a sum of squares of control deviation is applied to the evaluation function for calculating the operation amount of opening/closing the slice lip and the operation amount of at least one of the edge flow and the side bleed.

10. A fiber orientation control apparatus according to claim 9, wherein a method of steepest descent is applied with regard to the evaluation function for calculating the operation amount of opening/closing the slice lip and at least one of the operation amount of the edge flow and the operation amount of the side bleed.

11. A paper machine comprising:

a headbox to which a paper material is supplied and which comprises a slice lip at an exit that discharges the paper material;

a slice bolt which adjusts size of an open of the slice lip;

a slice bolt manipulation portion which controls the slice bolt;

a valve for adjusting a velocity distribution of the paper material at the exit of the headbox;

a valve manipulation portion which manipulates the valve;

a fiber orientation measuring unit which measures a fiber orientation of the paper material after a dehydration operation and generates fiber orientation data based on the fiber orientation;

a first control portion which generates an actual fiber orientation profile based on the fiber orientation data, calculates a fiber orientation deviation profile by comparing the actual fiber orientation profile to an ideal fiber orientation profile which is stored beforehand, and generates a change of operation amount based on both the fiber orientation deviation profile and a model parameter which is stored beforehand; and a second control portion which adjusts both a size of an open of the slice lip and a size of an open of the valve by controlling both the slice bolt manipulation portion and the valve manipulation portion in order to converge the actual fiber orientation profile at the ideal fiber orientation profile.

12. A paper machine according to claim 11, wherein the valve is an edge flow valve, and the valve manipulation portion is an edge flow valve manipulation portion.

13. A paper machine according to claim 11, wherein the valve is a side bleed valve, and the valve manipulation portion is a side bleed valve manipulation portion.

14. A paper machine according to claim 11, wherein the first control portion calculates a velocity component in a flow direction of the paper material that is proportional to changes in size of an open of the slice lip, calculates a velocity component which is orthogonal to a flow direction of the paper material by calculating a sum of both changes proportional to changes proportional to changes of a flow of the paper material discharged from the valve across a certain response width from the exit of the slice lip and changes proportional to an average value of differences of changes in size of an open in a cross direction of the slice lip, and calculates the fiber orientation profile based on both changes of a velocity component of the paper material and changes of a velocity component orthogonal to the paper material.

* * * * *